US009194603B2

(12) United States Patent
Yuan et al.

(10) Patent No.: US 9,194,603 B2
(45) Date of Patent: Nov. 24, 2015

(54) HEATING AND VENTILATING FAN

(75) Inventors: Hongjian Yuan, Guangdong (CN); Zhicong Zhang, Guangdong (CN); Zhusheng Hu, Guangdong (CN); Yefan Weng, Guangdong (CN); Guangmin Zeng, Guangdong (CN); Liang Tian, Guangdong (CN); Makoto Ishikawa, Aichi (JP)

(73) Assignees: Panasonic Ecology Systems Guangdong Co., Ltd., Guangdong (CN); Panasonic Corporation, Osaka (JP)

( * ) Notice: Subject to any disclaimer, the term of this patent is extended or adjusted under 35 U.S.C. 154(b) by 180 days.

(21) Appl. No.: 14/234,814

(22) PCT Filed: Aug. 9, 2012

(86) PCT No.: PCT/CN2012/079884

§ 371 (c)(1),
(2), (4) Date: Mar. 7, 2014

(87) PCT Pub. No.: WO2013/020515

PCT Pub. Date: Feb. 14, 2013

(65) Prior Publication Data

US 2014/0169771 A1 Jun. 19, 2014

(30) Foreign Application Priority Data

Aug. 10, 2011 (CN) ..... 2011 1 0227950
Apr. 27, 2012 (CN) ..... 2012 1 0129095

(51) Int. Cl.
*F24H 3/02* (2006.01)
*F24F 7/06* (2006.01)

(Continued)

(52) U.S. Cl.
CPC ..... *F24H 3/0417* (2013.01); *F04D 25/14* (2013.01); *F24F 7/007* (2013.01); *F24H 9/2071* (2013.01); *F24F 2221/34* (2013.01)

(58) Field of Classification Search
CPC combination set(s) only.
See application file for complete search history.

(56) References Cited

U.S. PATENT DOCUMENTS 3,692,977 A * 9/1972 Duhamel ..... F24F 7/06 219/220
3,722,395 A * 3/1973 Courchesne ..... F24F 7/06 454/235

(Continued)

FOREIGN PATENT DOCUMENTS

CN 1406329 3/2003
JP 2002054361 2/2002

(Continued)

OTHER PUBLICATIONS

International Search Report for Appln. No. PCT/CN2012/079884, dated Nov. 22, 2012.

(Continued)

*Primary Examiner* — Thor Campbell
(74) *Attorney, Agent, or Firm* — RatnerPrestia

(57) ABSTRACT

A heating and ventilating fan including a frame, a motor with fan blades, a casing, a heating device, and an air path switching plate disposed at an air outlet of the casing for switching outlets of the ventilating fan and a timing motor. The timing motor and the air path switching plate are fixed on either side of a frame wall. The air path switching plate is connected to the timing motor shaft through a connection part, and controls the air path switching plate to rotate by a constant angle in a single direction. A spring having a first end fixed to the frame wall, and a second end rotating synchronously with the air path switching plate controls the air path switching plate to rotate in an opposite direction to the single direction. When the timing motor is switched off, the spring returns the air path switching plate to its rest position.

13 Claims, 15 Drawing Sheets

(51) Int. Cl.

| | |
|---|---|
| ***F24H 3/04*** | (2006.01) |
| ***F04D 25/14*** | (2006.01) |
| ***F24H 9/20*** | (2006.01) |
| ***F24F 7/007*** | (2006.01) |

(56) References Cited

U.S. PATENT DOCUMENTS

| | | | | | |
|---|---|---|---|---|---|
| 3,815,485 | A * | 6/1974 | Beusink | F24F 7/06 | 454/338 |
| 4,401,149 | A * | 8/1983 | Iijima | B60H 1/00835 | 165/122 |
| 4,570,532 | A * | 2/1986 | Labelle | F24F 7/06 | 236/49.1 |
| 4,701,594 | A * | 10/1987 | Powell | A45D 20/16 | 219/203 |
| 4,865,118 | A * | 9/1989 | Moland | F24F 1/027 | 165/229 |
| 4,867,047 | A * | 9/1989 | Citron | B60H 1/26 | 126/286 |
| 5,295,531 | A * | 3/1994 | Tsunekawa | F24F 13/20 | 165/48.1 |
| 5,601,142 | A * | 2/1997 | Hildebrand | B60H 1/00035 | 165/137 |
| 5,934,362 | A * | 8/1999 | Barker, II | F24F 7/06 | 165/237 |
| 7,529,088 | B2 * | 5/2009 | Chiu | F04D 29/161 | 361/694 |
| 8,120,910 | B2 * | 2/2012 | Hong | H05K 7/20181 | 236/49.5 |
| 8,827,781 | B2 * | 9/2014 | Aderman | A01K 1/0058 | 454/254 |
| 8,851,831 | B2 * | 10/2014 | Sun | F04D 25/0613 | 361/679.49 |
| 9,022,846 | B1 * | 5/2015 | Tom | F24F 7/007 | 454/338 |
| 9,103,104 | B1 * | 8/2015 | Tom | E03D 9/052 | |
| 2007/0144727 | A1 * | 6/2007 | Hirayama | B60H 1/0005 | 165/203 |
| 2012/0077426 | A1 * | 3/2012 | Dage | B60H 1/00849 | 454/75 |
| 2012/0308214 | A1 * | 12/2012 | Tyburk | F24F 13/20 | 392/407 |
| 2013/0203336 | A1 * | 8/2013 | Karst | F24F 7/06 | 454/249 |

FOREIGN PATENT DOCUMENTS

| | | |
|---|---|---|
| JP | 2006046669 | 2/2006 |
| JP | 2008157537 | 7/2008 |
| JP | 2009180389 | 8/2009 |

OTHER PUBLICATIONS

Written Opinion for Appln. No. PCT/CN2012/079884, dated Oct. 25, 2012.

* cited by examiner

10

HEATING AND VENTILATING FAN

BACKGROUND OF THE INVENTION

1. Field of the Invention

The present invention relates to a ventilating fan, and particularly to a heating and ventilating fan.

2. Description of the Related Art

FIGS. 1A and 1B are schematic views of an existing heating and ventilating fan. As shown in FIGS. 1A and 1B, the heating and ventilating fan 15 comprises a frame 151, a motor 152 with fan blades, a casing 153, a heating device 154, an air path switching plate 157 disposed at an air outlet 155 of the casing 153 for switching outlets of the ventilating fan, and a stepping motor 158 for driving the air path switching plate 157 to rotate. When the heating and ventilating fan 15 operates, a circuit board sends a signal to control the stepping motor 158 to rotate, thereby driving the air path switching plate 157 to rotate. When the heating and ventilating fan 15 operates in a heating mode, the air path switching plate 157 blocks the ventilation outlet 159 of the frame 151, air is sucked from a suction port 156 of the heating and ventilating fan, passes the heating device 154 and then flows into a room for achieving the function of heating. When the heating and ventilating fan operates in a ventilation mode, the air path switching plate 157 blocks the heating outlet 160 of the frame 151 and air flows out of the room along an adapter for achieving the function of ventilation.

In the above prior art heating and ventilating fan for a bath room, it is necessary to send a signal to the stepping motor 158 by the circuit board, and then control the air path switching plate 157 to rotate by the stepping motor 158. As a result, a cost of the heating and ventilating fan is increased by employing the circuit board, the stepping motor and relevant components.

SUMMARY OF THE INVENTION

It is an object of the present invention to provide a heating and ventilating fan which switches between ventilation and heating functions by a timing motor and a spring.

In order to achieve the above object, the present invention provides a heating and ventilating fan comprising: a frame, a motor with fan blades, a casing, a heating device, and an air path switching plate disposed at an air outlet of the casing for switching outlets of the ventilating fan. The heating and ventilating fan further comprises a timing motor, wherein the timing motor and the air path switching plate are fixed on both sides of a frame wall, respectively, the air path switching plate is connected to a shaft of the timing motor through a connection part, and the timing motor controls the air path switching plate to rotate by a constant angle in a single direction; and a spring having a first end fixed to the frame wall, and a second end rotating synchronously with the air path switching plate, wherein the spring controls the air path switching plate to rotate in an opposite direction to the single direction, and when the timing motor is deenergized, the spring returns the air path switching plate to its rest position.

The connection part has a rear end fixed to the shaft of the timing motor, and a front end fixed in a hollow shaft of the air path switching plate after passing through a connection hole formed in the frame wall, and the second end of the spring is fixed to the front end of the connection part.

The front end of the connection part has a D-shaped cross section, a D-shaped hole is disposed in the hollow shaft of the air path switching plate, and the front end of the connection part is inserted and engaged in the D-shaped hole of the hollow shaft.

The shaft of the timing motor is configured in a D-shape, and a D-shaped hole is disposed inside the rear end of the connection part, and is inserted the shaft of the timing motor.

The first end of the spring is formed into a rear hook, the second end of the spring is formed into a front hook, and a spiral cylinder is formed between the front hook and the rear hook; the front hook is shaped to cross the spiral cylinder diametrically, and inserted in a slit disposed in a center of the connection part to be fixed to the connection part; and the rear hook projects outwards from the spiral cylinder.

A cylinder wall is disposed at the rear end of the connection part around the center to be spaced from the center, and the cylinder wall is provided with a notch larger than or equal to a range of an angle of rotation of the connection part.

The rear hook of the spring projects outwards from the spiral cylinder beyond the notch of the cylinder wall and is formed in a Z-shape, and a part of the rear hook of the spring can rotate in the notch.

A positioning piece for fixing a position of the rear hook of the spring is formed on a side of the frame wall on which the timing motor is fixed, the positioning piece protrudes from an inside surface of the frame wall and a guide piece is disposed above the positioning piece to guide the rear hook of the spring to engage with the positioning piece, and an external side of the guide piece is shorter and an internal side of the guide piece adjoining the positioning piece is longer so that an inclined surface is formed to be inclined towards the positioning piece.

An inner circular ring is formed at a periphery of the connection hole of the frame wall, and an outer circular ring surrounding the inner circular ring is also disposed at the periphery of the connection hole of the frame wall, and the cylinder wall of the connection part is mounted between the inner circular ring and the outer circular ring.

Whether the ventilating fan is in a heating mode or in a ventilation mode, the air path switching plate is located in a position in which it blocks the ventilation outlet when the ventilating fan is stopped.

The present invention is advantageous in that the heating and ventilating fan switches between ventilation and heating functions by the timing motor and the spring without a circuit board, thereby reducing its cost.

It is a secondary object of the present invention to particularly provide a heating and ventilating fan with a safe connection circuit.

In order to achieve the above object, the heating and ventilating fan provided by the present invention further comprises a relay for switching a heating device drive circuit for energizing the heating device or an air path switching plate drive circuit for energizing the air path switching plate, and when a coil of the relay is energized or deenergized, only one of the air path switching plate drive circuit and the heating device drive circuit is energized.

The heating and ventilating fan further comprises a terminal block for receiving a power supplied from a power source, the terminal block has a first terminal connected to a pole of the power source, a second terminal connected to the other pole of the power source, and a third terminal, the relay has a common terminal, a normally closed terminal, and a normally opened terminal, the coil of the relay is connected between the first terminal and the second terminal of the terminal block, the common terminal is connected to the third terminal, the air path switching plate drive circuit is connected between the first terminal and the normally closed terminal, the heating device drive circuit is connected between the first terminal and the normally opened terminal, and a fan motor circuit for driving the motor with the fan blades is connected between the first terminal and the common terminal.

A first switch and a second switch connected in series are disposed between the second terminal and the other pole of the power source, and the first switch is disposed between the third terminal and the other pole of the power source.

The present invention is also advantageous in that safety of the product is improved while its cost is reduced and wire connection operation is simplified because only one of the air path switching plate drive circuit and the heating device drive circuit is energized when the coil of the relay is energized or deenergized.

DETAILED DESCRIPTION OF THE EMBODIMENTS

Figure 1A:
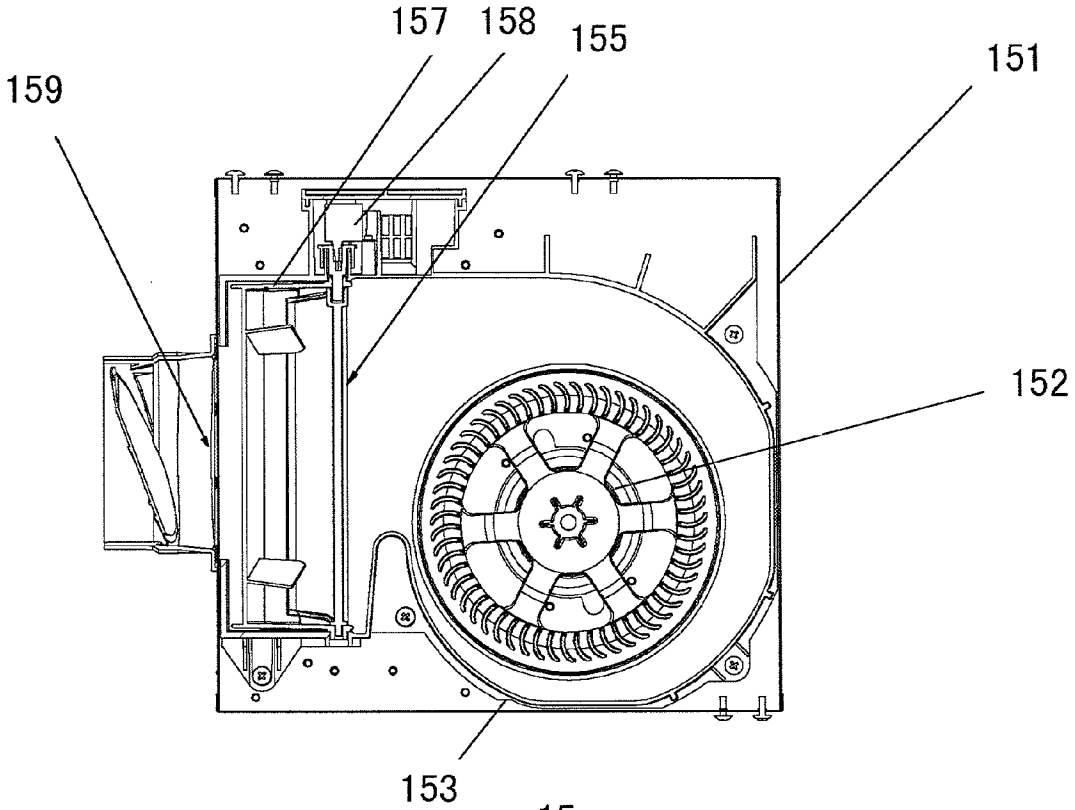
FIGS. 1A and 1B are schematic views of an existing heating and ventilating fan.
Figure 1B:
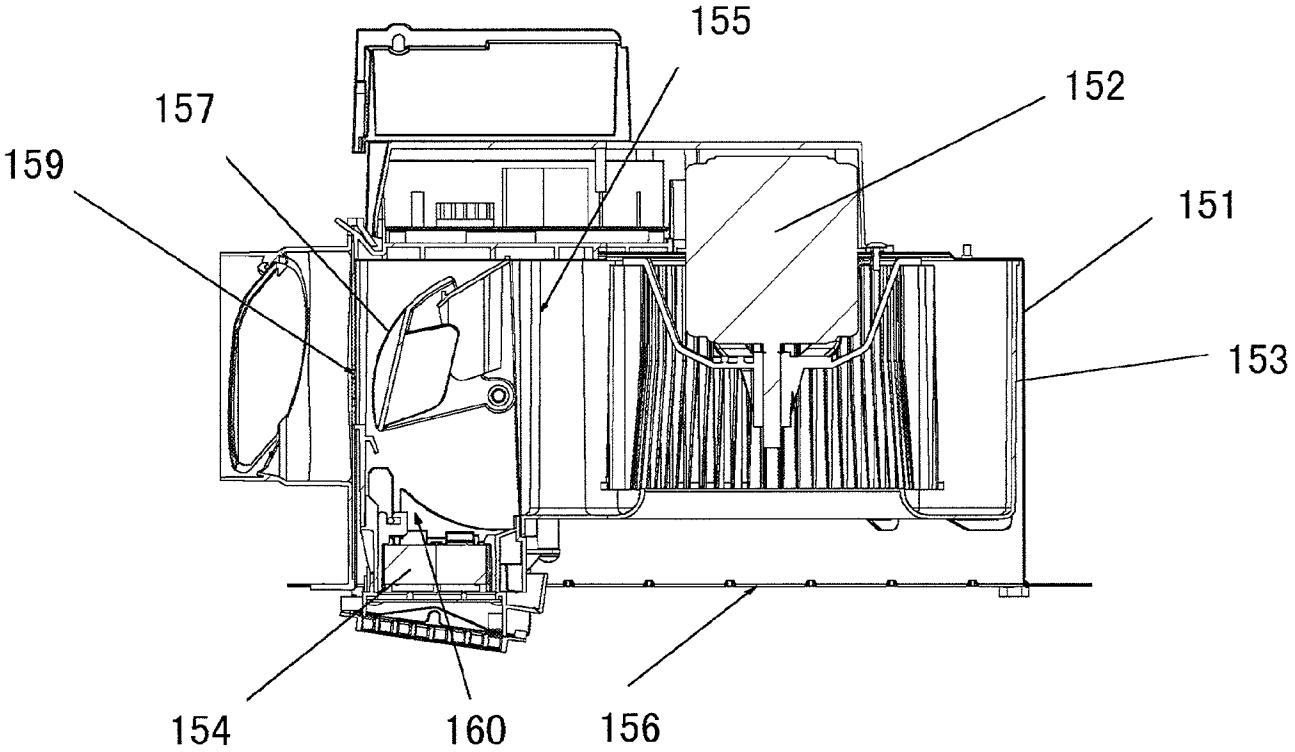
Figure 2:
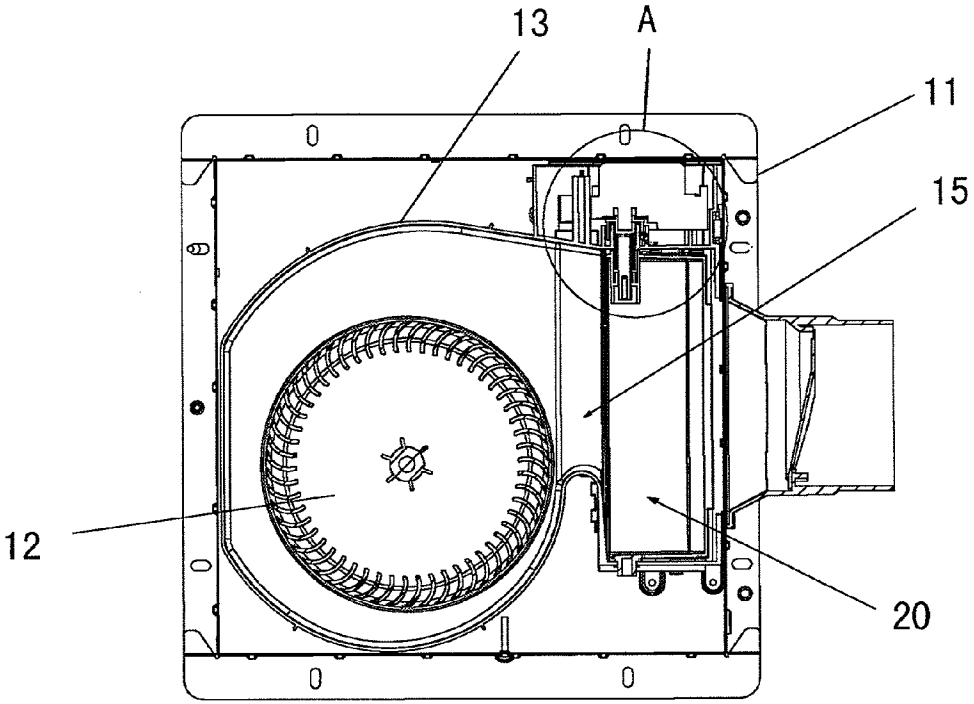
FIG. 2 is a section view of an entire heating and ventilating fan of the present invention.
Figure 3:
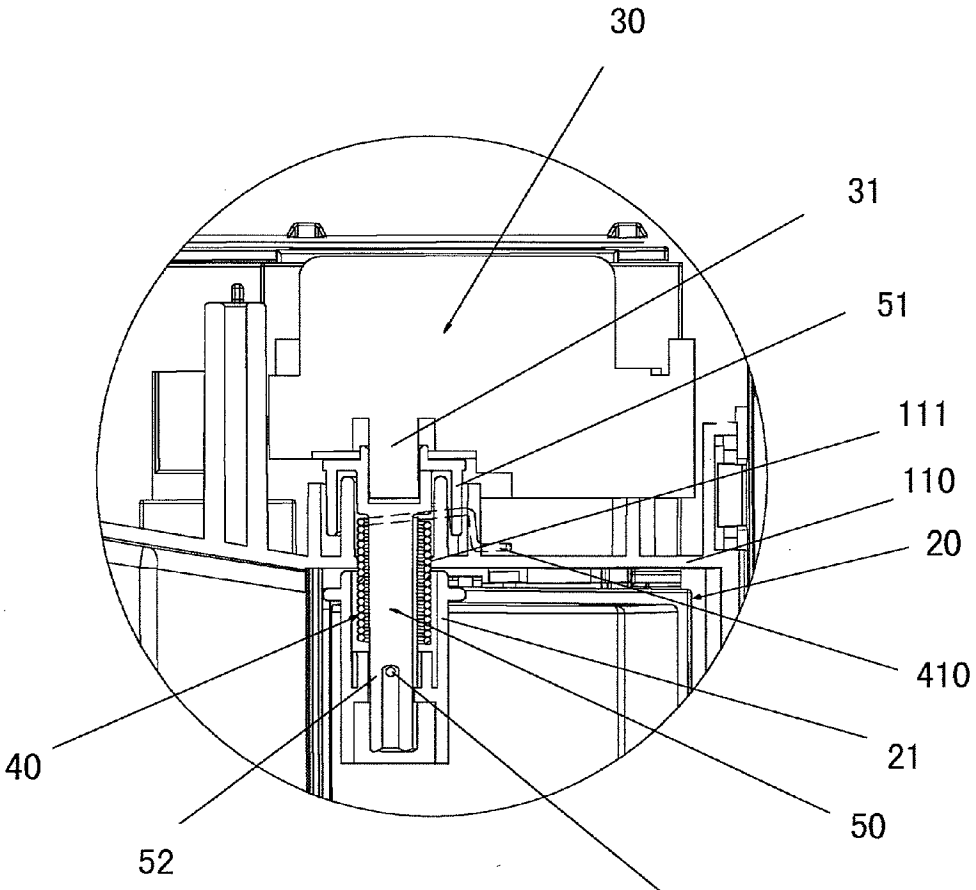
FIG. 3 is a section view showing the part A (connection between an air path switching plate and a timing motor) of FIG. 2.

FIG. 2 is a schematic view of an entire heating and ventilating fan of the present invention; and FIG. 3 is a section view showing the part A (connection between an air path switching plate and a timing motor) of FIG. 2.

As shown in FIGS. 2 and 3, the heating and ventilating fan 10 comprising: a frame 11, a motor 12 with fan blades, a casing 13, a heating device (Fig is not shown), and an air path switching plate 20 disposed at an air outlet 15 of the casing 13 for switching outlets of the ventilating fan 10. The heating and ventilating fan further comprises a timing motor 30, and the timing motor 30 and the air path switching plate 20 are fixed on both sides of a frame wall 110, respectively. The air path switching plate 20 is connected to a shaft 31 of the timing motor 30 through a connection part 50, and the timing motor 30 controls the air path switching plate 20 to rotate by a constant angle in a single direction. The connection part 50 has a rear end 51 fixed to the shaft 31 of the timing motor 30, and a front end 52 fixed in a hollow shaft 21 of the air path switching plate 20 after passing through a connection hole 111 formed in the frame wall 110. The heating and ventilating fan further comprises a spring 40, and the spring 40 has a first end formed into a rear hook 410 and fixed to the frame wall 110, and a second end formed into a front hook 420 and fixed to the front end 52 of the connection part 50. The second end where the front hook 420 is located rotates synchronously with the air path switching plate 20. The spring 40 controls the air path switching plate 20 to rotate in an opposite direction to the single direction, and when the timing motor 30 is deenergized, the spring 40 returns the air path switching plate 20 to its rest position.

Figure 4A:
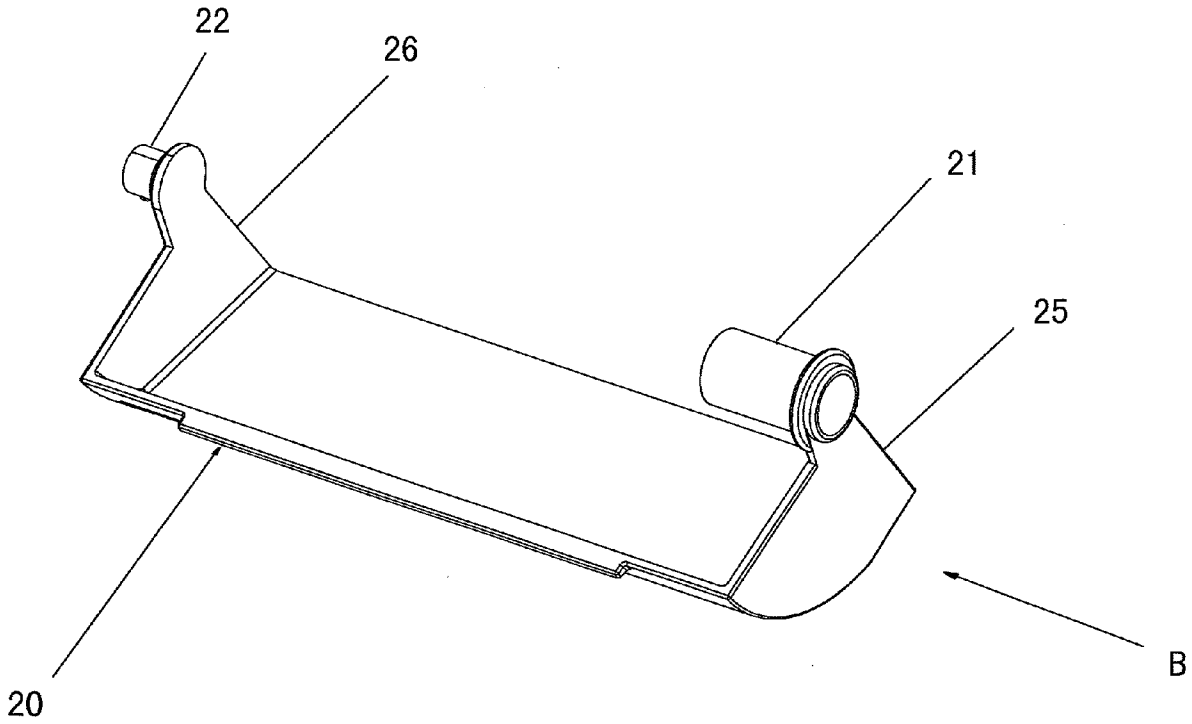
FIG. 4A is a schematic view of the air path switching plate of the present invention.
Figure 4B:
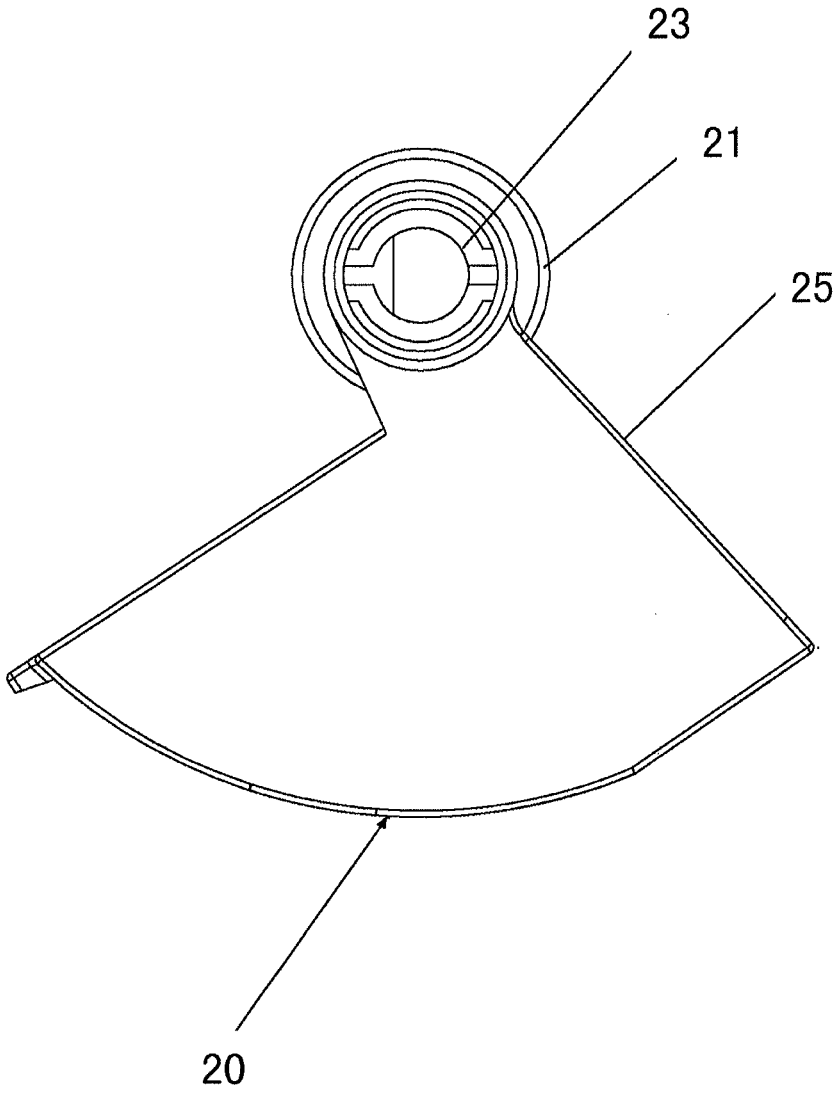
FIG. 4B is a schematic view when viewed in the direction B of FIG. 4A.

FIG. 4A is a schematic view of the air path switching plate of the present invention; and FIG. 4B is a schematic view when viewed in the direction B of FIG. 4A. As shown in FIGS. 4A and 4B, the air path switching plate 20 is a plate body for switching the air path 20 by its rotation. The air path switching plate 20 is provided with the hollow shaft 21 at an end 25. A D-shaped hole 23 is disposed in the hollow shaft 21. The air path switching plate 20 is provided with a solid shaft 22 at the other end 26. The solid shaft 22 is mounted to a frame wall 120 on the other side.

Figure 5A:
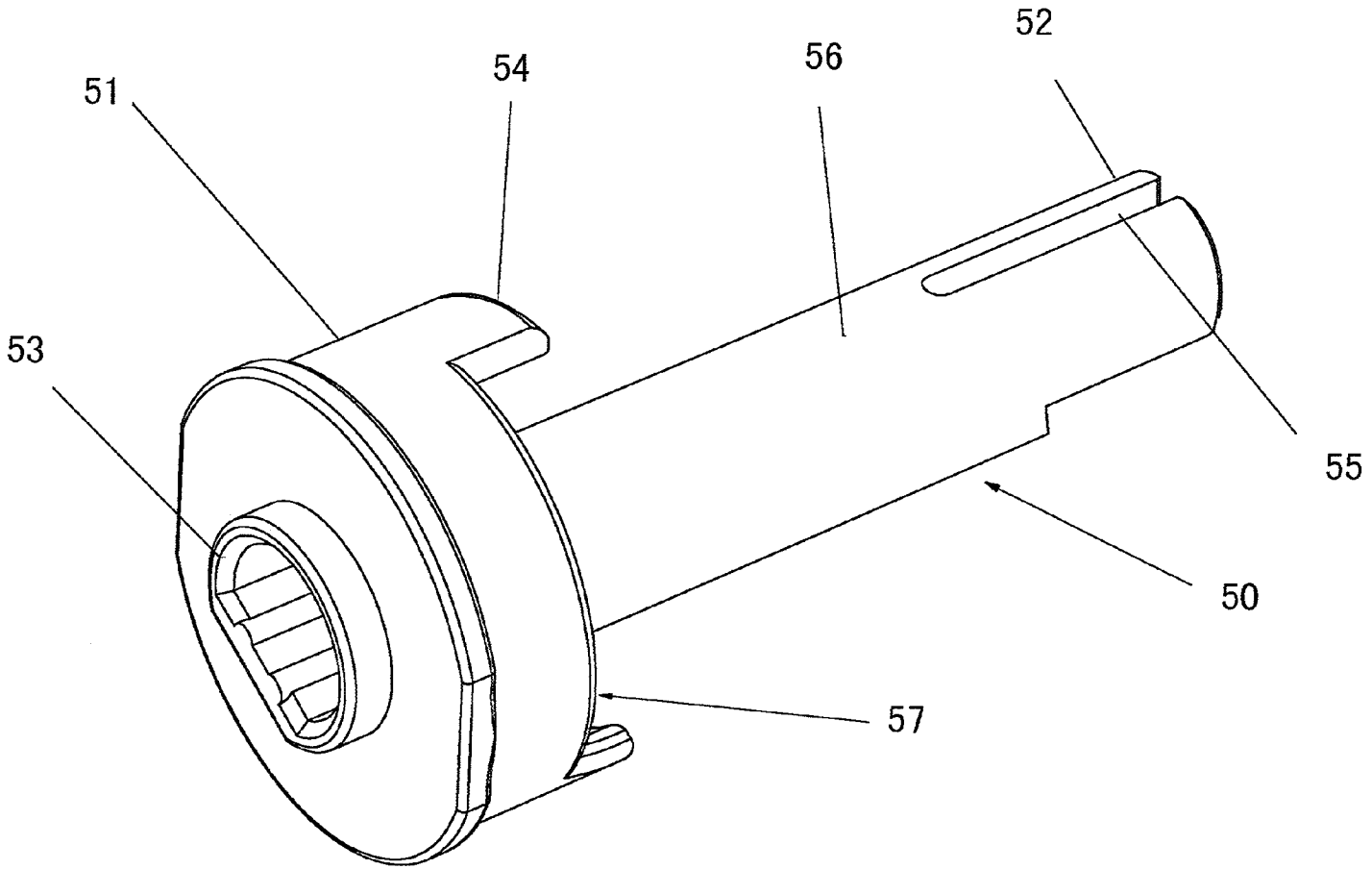
FIGS. 5A and 5B are schematic views of a connection part of the present invention.
Figure 5B:
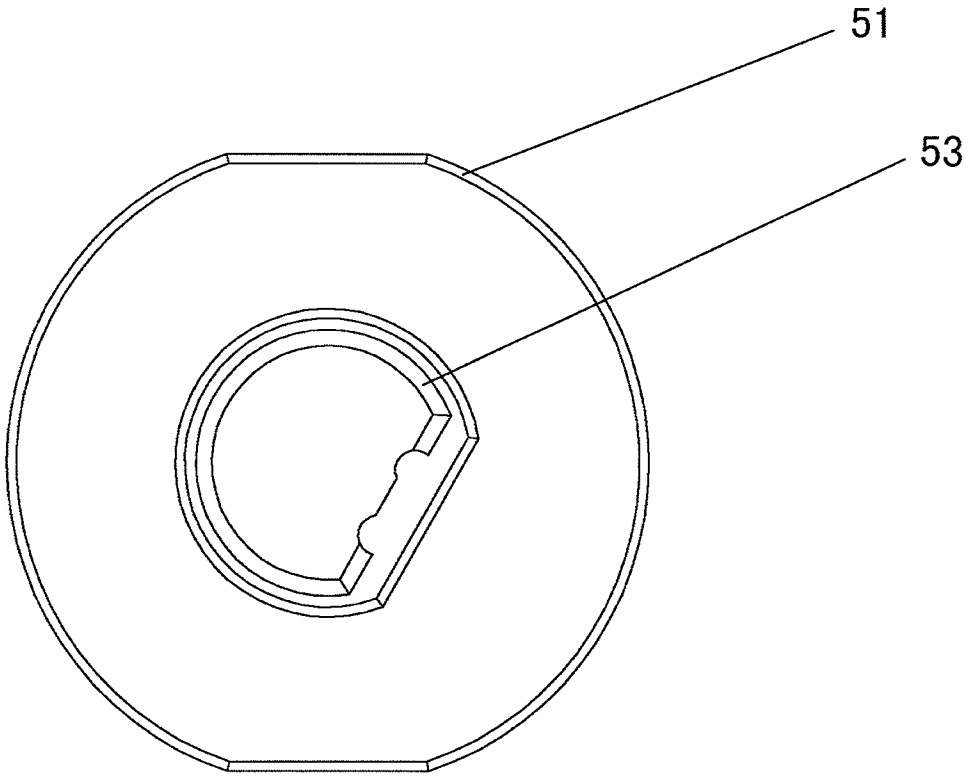
Figure 8:
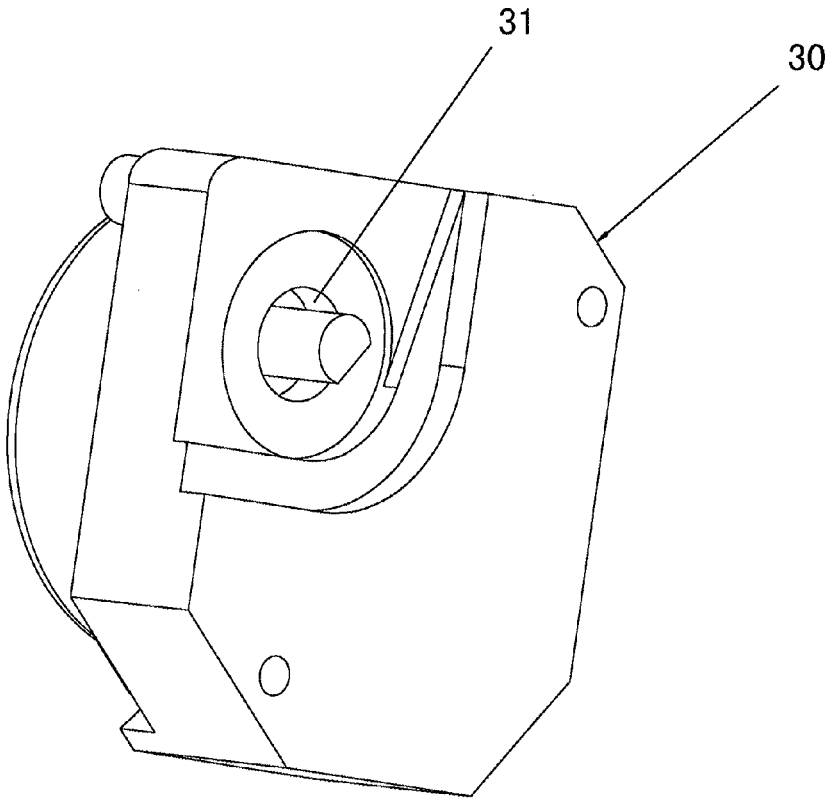
FIG. 8 is a schematic view of the timing motor of the present invention.

FIGS. 5A and 5B are schematic views of the connection part of the present invention. FIG. 8 is a schematic view of the timing motor of the present invention. As shown in FIG. 5A, the front end 52 of the connection part 50 has a D-shaped cross section, and can be inserted and engaged in the D-shaped hole 23 of the hollow shaft 21 of the air path switching plate 20. A middle part of the connection part 50 is a sleeve shaft 56 surrounded by the spring 40. A D-shaped hole 53 is disposed inside the rear end 51 of the connection part 50. Because the shaft 31 of the timing motor 30 is also configured in a D-shape, the D-shaped hole 53 can be inserted the shaft 31 of the timing motor 30. A cylinder wall 54 is disposed at the rear end 51 of the connection part 50 around the center to be spaced from the center, and the cylinder wall 54 is provided with a notch 57 larger than or equal to a range of an angle of rotation of the connection part 50.

Figure 6:
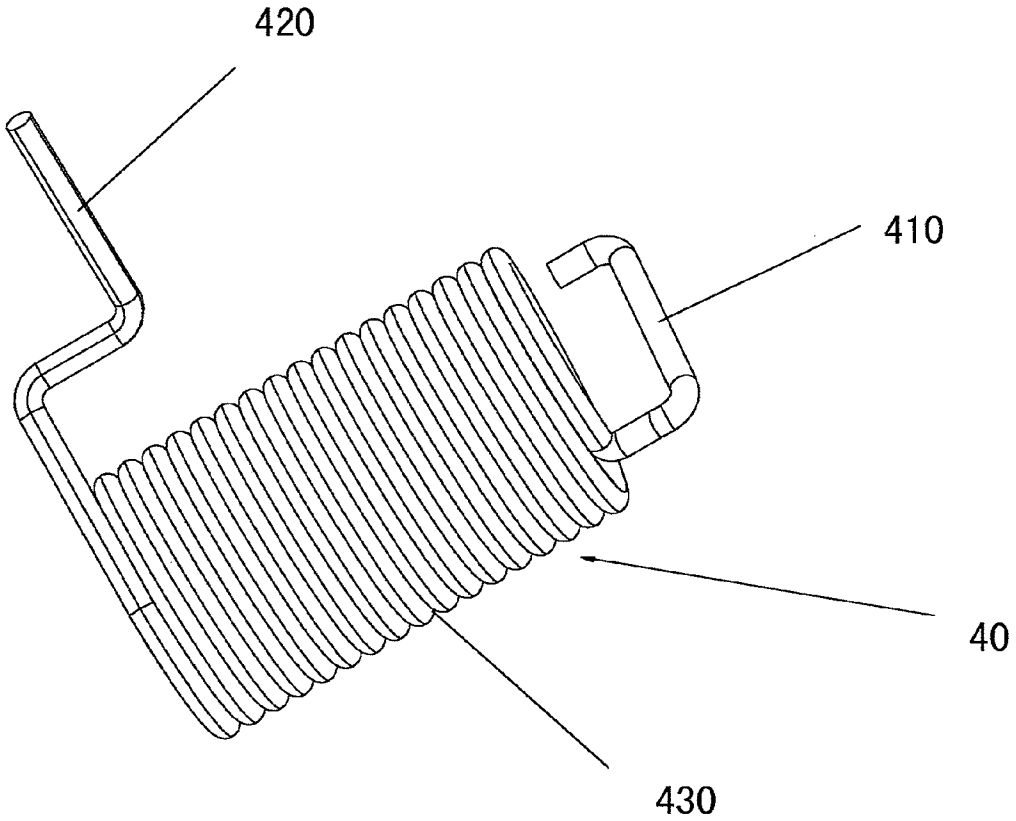
FIG. 6 is a schematic view of a spring of the present invention.
Figure 7:
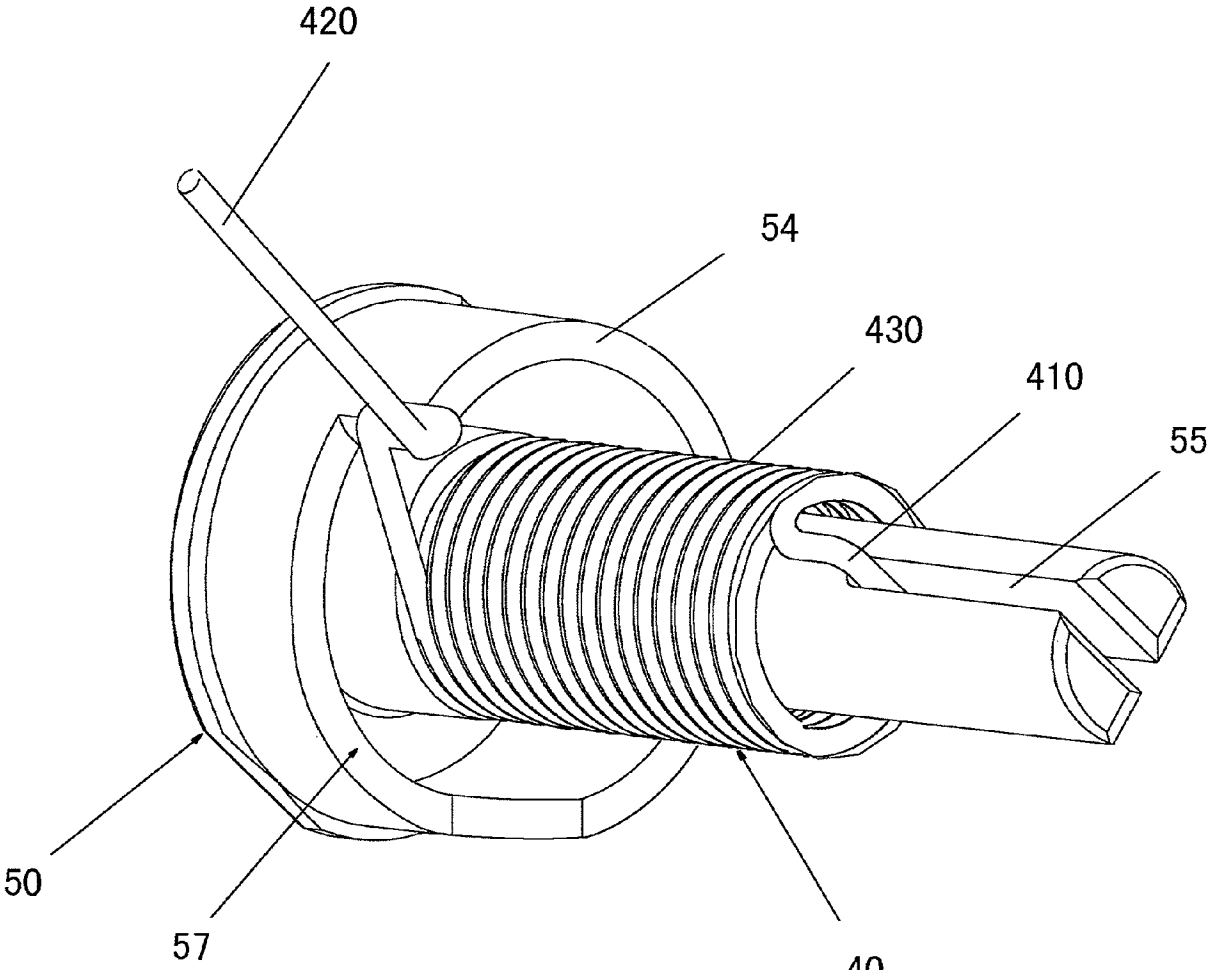
FIG. 7 is a schematic view of the spring of the present invention mounted to the connection part.

FIG. 6 is a schematic view of the spring of the present invention. FIG. 7 is a schematic view of the spring of the present invention mounted to the connection part. As shown in FIGS. 6 and 7, a spiral cylinder 430 is formed between the front hook 410 and the rear hook 420. The front hook 410 is shaped to cross or transverse the spiral cylinder 430 diametrically, and the front hook 410 is fixed to the connection part 50 by being inserted in a slit 55 disposed in the center of the connection part 50. The rear hook 420 projects outwards from the spiral cylinder 430 beyond the notch 57 of the cylinder wall 54 of the connection part 50 and is formed in a Z-shape, and a part of the rear hook 420 can rotate in the notch 57. In the state where the spring 40 is located in the cylinder wall 54, the part of the rear hook 420 can be rotated, and the strength of the spring 40 is enhanced.

Figure 9:
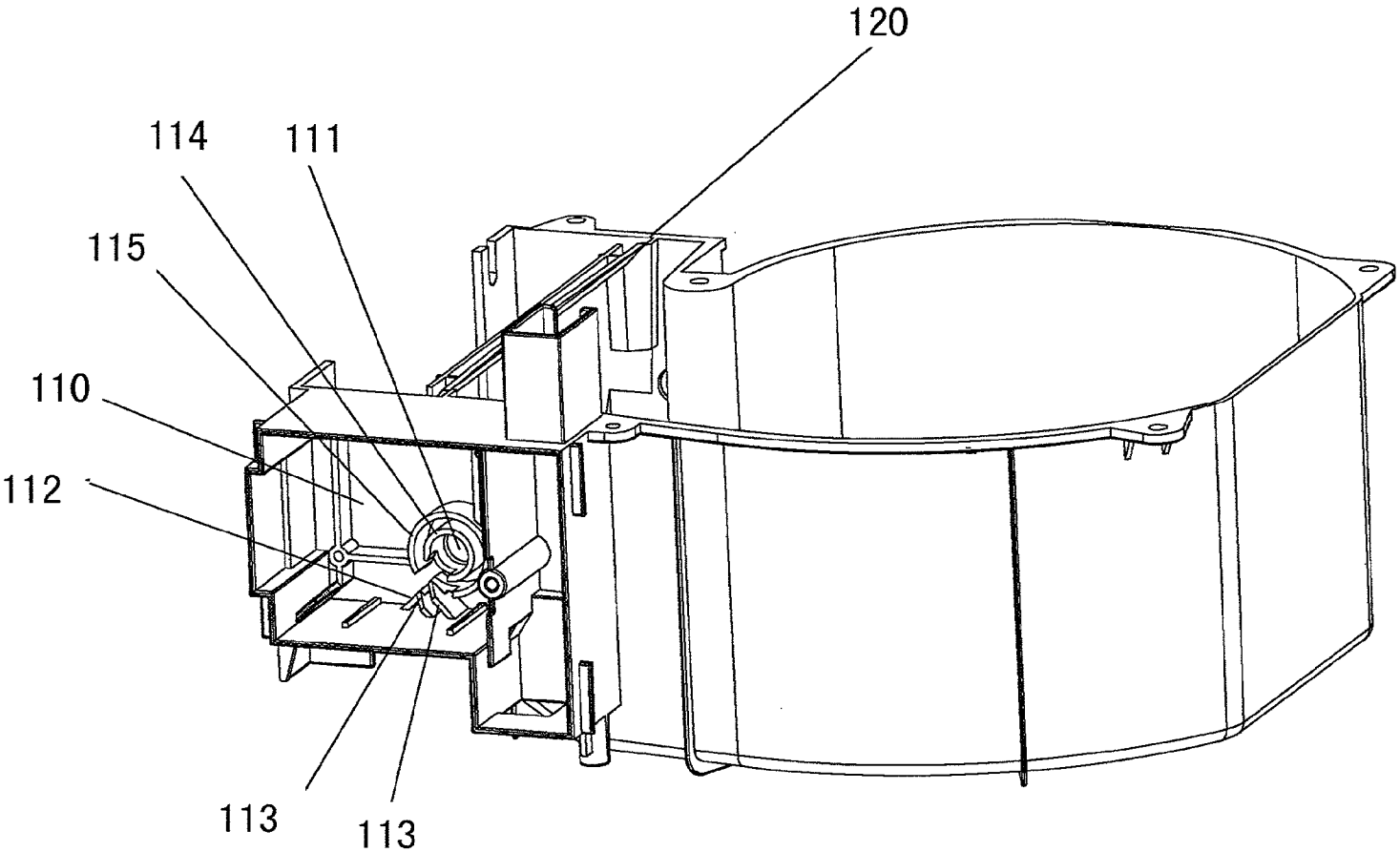
FIG. 9 is a schematic view of a frame wall of the present invention on a side on which the timing motor is mounted.

FIG. 9 is a schematic view of the frame wall of the present invention on a side on which the timing motor is mounted. As shown in FIG. 9, a positioning piece 112 for fixing a position of the rear hook 420 of the spring 40 is formed on the side of the frame wall 110 on which the timing motor 30 is fixed. The positioning piece 112 protrudes from an inside surface of the frame wall 110 and a guide piece 113 is disposed above the positioning piece 112 to guide the rear hook 420 of the spring 40 to engage with the positioning piece 112, and an external side of the guide piece 113 is shorter and an internal side of the guide piece adjoining the positioning piece 112 is longer so that an inclined surface is formed to be inclined towards the positioning piece 112. An inner circular ring 114 is formed at a periphery of the connection hole 111 of the frame wall 110, and an outer circular ring 115 surrounding the inner circular ring 114 is also disposed at the periphery of the connection hole of the frame wall 110, and the cylinder wall 54 of the connection part 50 is mounted between the inner circular ring 114 and the outer circular ring 115.

Figure 10:
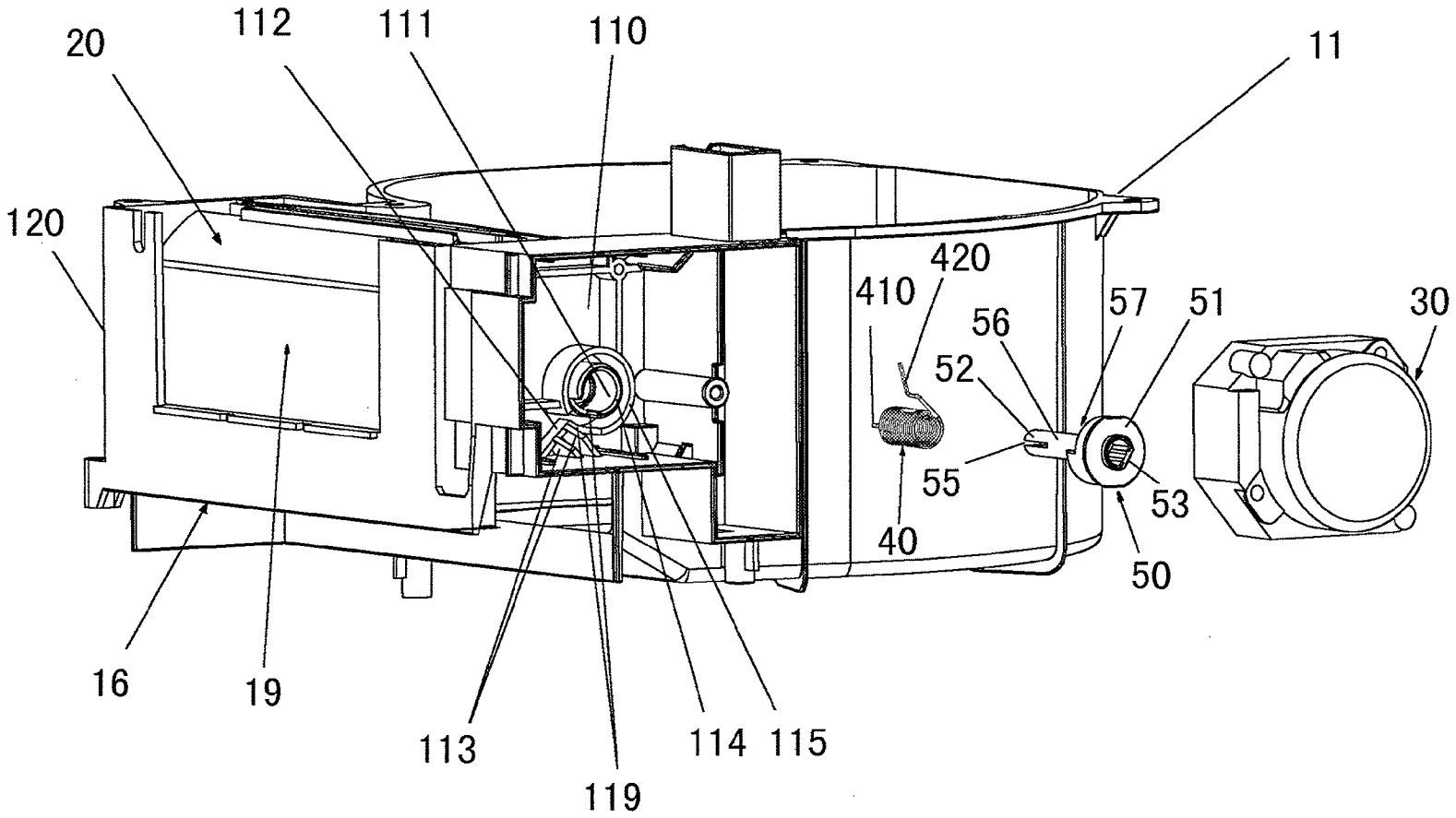
FIG. 10 is a schematic view of the entire heating and ventilating fan of the present invention in a mounted state.

FIG. 10 is a schematic view of the entire heating and ventilating fan of the present invention in a mounted state. The mounting process is described below by referring to the figure.

Firstly, the spring 40 is mounted to the connection part 50. Specifically, the spring 40 is first fitted over the sleeve shaft 56 at the middle part of the connection part 50, and then the spring 40 is fixed to the connection part 50 by inserting the front hook 410 of the spring 40 in the slit 55 disposed in the center of the connection part 50. Since the front hook 410 of the spring 40 is fixed in the slit 55 disposed in the center of the connection part 50, the connection part 50 can drive the front hook 410 of the spring 40 to rotate when the connection part 50 rotates.

Next, the connection part 50 is mounted to the timing motor 30. Specifically, the D-shaped hole 53 disposed inside the rear end 51 of the connection part 50 is engaged on the shaft 31 of the timing motor 30.

Then, the timing motor 30 integrally fixed to the connection part 50 is mounted. Specifically, the front end 52 of the connection part 50 is first aligned with the hollow shaft 21 of the air path switching plate 20, the rear hook 420 of the spring 40 is aligned with the positioning piece 112 disposed on the frame wall 110 for defining the position of the rear hook 420, and then the timing motor 30 is engaged in the frame wall 110, thereby mounting the timing motor 30 integrally fixed to the connection part 50 in the frame wall 110. In that case, the rear hook 420 is locked on the positioning piece 112 of the frame wall 110. Since the cylinder wall 54 of the connection part 50 is provided with the notch 57, the connection part 50 can rotate without coming into contact with the rear hook 420 of the spring 40 fixed to the frame wall 110 (which cannot be moved).

The function of the positioning piece 112 is to fix the position of the rear hook 420 of the spring 40. Since the positioning piece 112 protrudes from the inside surface of the frame wall 110, the rear hook 420 of the spring 40 can be fixed.

The guide piece 113 is disposed above the positioning piece 112 to guide the rear hook 420 of the spring 40 to engage with the positioning piece 112, and the external side of the guide piece 113 is shorter and the internal side of the guide piece adjoining the positioning piece 112 is longer so that the inclined surface is formed to be inclined towards the positioning piece 112. When the timing motor 30 integrally fixed to the connection part 50 is mounted, the guide piece 113 guides the rear hook 420 of the spring 40 to slide along the inclined surface onto the positioning piece 112, thereby facilitating mounting. The cylinder wall 54 of the connection part 50 is mounted between the inner circular ring 114 and the outer circular ring 115, and can rotate between the inner circular ring 114 and the outer circular ring 115. The two circular rings are each provided with an opening 119 allowing the rear hook 420 of the spring 40, mounted to the connection part 50, to be locked on the positioning piece 112 of the frame wall 110 for engagement therewith.

In addition, even if the opening 119 is disposed as a slit, the slit will not affect rotation of the spring 40. However, if the opening 119 is disposed as a slit, it is very difficult to align the rear hook 420 of the spring 40 with the slit and insert the rear hook 420 of the spring 40 into the slit when the connection part 50 integrally connected to the timing motor 30 is mounted. Therefore, operation to lock the rear hook 420 of the spring 40 at the positioning piece 112 is made simpler by disposing the opening 119 and the guide piece 113.

A distance from the air path side to the shaft 31 of the timing motor 30 becomes longer by mounting the cylinder wall 54 of the connection part 50 between the inner circular ring 114 and the outer circular ring 115, so that moisture from the air path can be prevented from entering the timing motor 30.

It shall be noted that when the connection part 50 integrally connected to the timing motor 30 is mounted, the air path switching plate 20 may first be rotated to the position in which it blocks the ventilation outlet 19 of the frame 11, then the connection part 50 is rotated according to orientation of the D-shaped hole 53 of the hollow shaft 21 of the air path switching plate 20, and after the D-shaped front end 52 of the connection part 50 and the D-shaped hole 53 inside the hollow shaft 21 are caused to be consistent with each other in orientation, the front end 52 of the connection part 50 passes through the connection hole 111 of the frame wall 110 and after that, the front end 52 of the connection part 50 is inserted into the hollow shaft 21 of the air path switching plate 20. The inside of the hollow shaft 21 and the front end 52 of the connection part 50 have the D-shape with the same orientation. Therefore, when the connection part 50 rotates, the connection part 50 can drive the hollow shaft 21 to rotate, thereby rotating the air path switching plate 20.

After completing the mounting, the spring 40 is mounted to the connection part 50, the spring 40 and the connection part 50 connected together are mounted to the timing motor 30, and the timing motor 30 is mounted to the frame wall 110. The front end 52 of the connection part 50 is engaged in the hollow shaft 21 of the air path switching plate 20 so that the connection part 50 and the air path switching plate 20 are connected together.

As a result, the air path switching plate 20, the connection part 50, and the timing motor 30 are connected together. The timing motor 30 generates power by rotating. The power drives the connection part 50 to rotate, and is transmitted to the air path switching plate 20 through the connection part 50, thereby driving the air path switching plate 20 to rotate.

After the heating and ventilating fan is assembled, both the timing motor 30 and the spring 40 are connected to the air path switching plate 20, and the timing motor 30 and the spring 40 drive the air path switching plate 20 to rotate.

When a user selects the ventilation mode, the timing motor 30 rotates to generate power, and thus drives the connection part 50 to rotate by a preset angle in a counter-clockwise direction as shown in FIG. 10, thereby driving the air path switching plate 20 to rotate downwards, that is, to rotate to the position of the ventilation mode in which it blocks the heating outlet 16 of the frame 11. In that case, since the rear hook 420 of the spring 40 is located by the positioning piece 112 so as not to be able to rotate, but the front hook 410 can be driven to rotate by the connection part 50. Therefore, the spring 40 is in a state where it is deformed by being compressed. When the ventilating fan is stopped, on deenergization of the timing motor 30, a pressure applied to the spring 40 is removed, and the spring 40 restores into an uncompressed natural state. In other words, the spring 40 returns in an opposite direction to the rotational direction of the timing motor 30, thereby generating power. The spring 40 drives the connection part 50 to rotate, thereby driving the air path switching plate 20 to return to its rest position, that is, driving the air path switching plate 20 to return to the position in which it blocks the ventilation outlet 19 of the frame 11.

The term "rest position" means a position in which the air path switching plate 20 is located after the heating and ventilating fan is stopped or before the heating and ventilating fan operates. In the present invention, after the heating and ventilating fan is stopped or before the heating and ventilating fan operates, the air path switching plate 20 is located in the position in which it blocks the ventilation outlet of the frame 11, that is, the position of the heating mode of the heating and ventilating fan. In other words, whether the ventilating fan is in the heating mode or in the ventilation mode, the air path switching plate 20 is located in the position in which it blocks the ventilation outlet 19 when the ventilating fan is stopped. Therefore, the air is blocked by the air path switching plate 20. The air can be prevented from entering the ventilating fan from the ventilation outlet 19 during stop of the ventilating fan.

When a user selects the heating mode after the ventilating fan operates, since the air path switching plate 20 has been located in the position of the heating mode of the heating and ventilating fan, the timing motor 30 does not drive the air path switching plate 20 to rotate, and the air path switching plate 20 continues to block the ventilation outlet 19 of the frame 11 and guides the air to flow through the heating device into a room for achieving the function of heating.

The rotation of the air path switching plate 20 is controlled with the above structure. Therefore, it is not necessary to send a signal to control a stepping motor to rotate by a circuit board, and when the heating and ventilating fan is assembled, it is not necessary to carry out antistatic processing, thereby reducing man hour of assembly of the product.

Figure 11A:
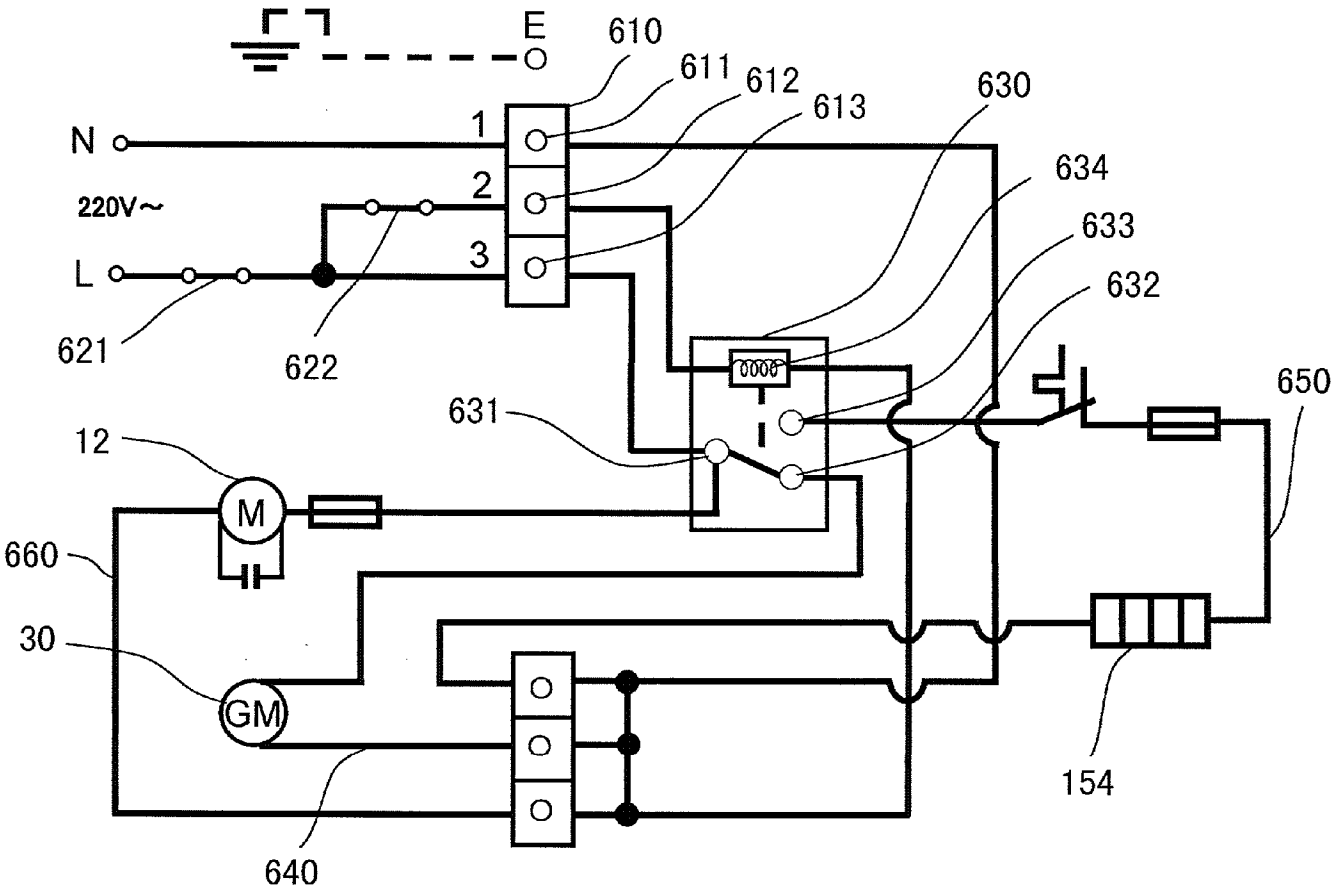
FIG. 11A is a schematic view showing a connectional relationship of a wire connection circuit of the heating and ventilating fan of the present invention in a heating mode.
Figure 11B:
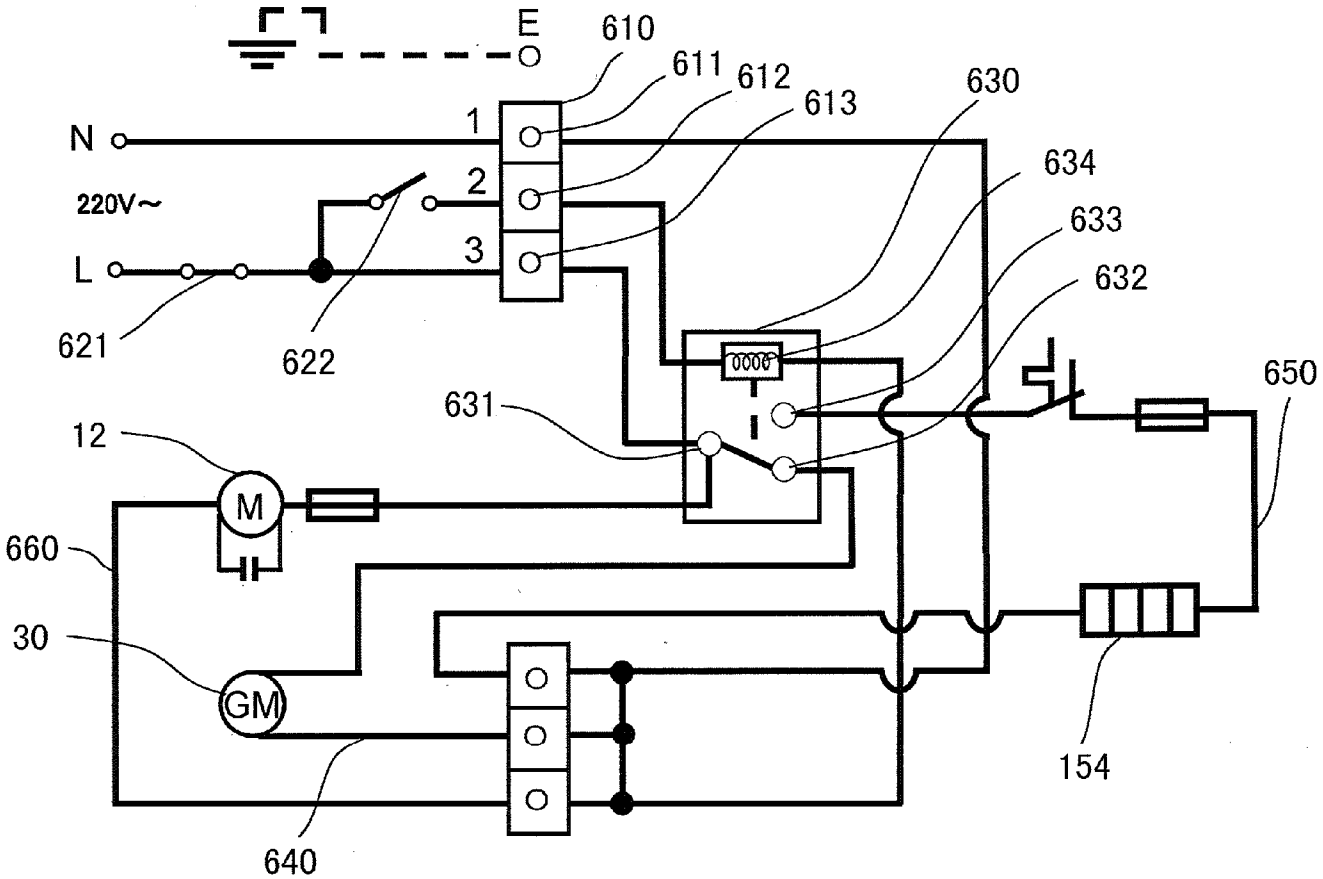
FIG. 11B is a schematic view showing a connectional relationship of the wire connection circuit of the heating and ventilating fan of the present invention in a ventilation mode.

FIG. 11A is a schematic view showing a connectional relationship of a wire connection circuit of the heating and ventilating fan of the present invention in the heating mode; and FIG. 11B is a schematic view showing a connectional relationship of the wire connection circuit of the heating and ventilating fan of the present invention in the ventilation mode.

As described above, the air path switching plate 20 is driven by energizing the timing motor 30, so that the interior air path becomes the ventilation path. In addition, when the timing motor 30 is energized, the interior air path is restored to the structure of the above circulation air path by resilience of the spring.

The wire connection circuit of the heating and ventilating fan comprises a terminal block 610 for receiving a power supplied from a power source. The terminal block 610 has a first terminal 611 connected to a neutral wire N as a pole of the power source, a second terminal 612 connected to a live wire L as the other pole of the power source, and a third terminal 613. A first switch 621 and a second switch 622 connected in series are disposed between the second terminal 612 and the live wire L of the power source, and the first switch 621 is disposed between the third terminal 613 and the live wire L of the power source. In the present invention, a relay 630 is disposed for switching a heating device drive circuit 650 for energizing the heating device 154 or an air path switching plate drive circuit 640 for energizing the air path switching plate 20, and when a coil 634 of the relay 630 is energized or deenergized, only one of the air path switching plate drive circuit 640 and the heating device drive circuit 650 is energized. The relay 630 has a common terminal 631, a normally closed terminal 632, and a normally opened terminal 633. The coil 634 of the relay 630 is connected between the first terminal 611 and the second terminal 612 of the terminal block 610, the common terminal 631 is connected to the third terminal 613, the air path switching plate 20 drive circuit 640 is connected between the first terminal 611 and the normally closed terminal 632, the heating device drive circuit 650 is connected between the first terminal 611 and the normally opened terminal 633, and a fan motor circuit 660 for driving the motor 12 with the fan blades is connected between the first terminal 611 and the common terminal 631.

With the above structure, when a user uses the heating mode, as shown in FIG. 11A, firstly, the first switch 621 is closed to complete the fan motor circuit 660, thereby energizing and operating the motor 12. Then, the second switch 622 is brought into a closed state to energize the coil 634 of the relay 630 for generating an electromagnetic force. The common terminal 631 and the normally opened terminal 633 are connected to supply power to the heating device drive circuit 650 so that the heating device 154 generates heat. When the timing motor 30 is in a deenergized state, the air path switching plate 20 is located in the position of the heating mode of the heating and ventilating fan, i.e., the air path switching plate 20 blocks the ventilation outlet of the frame of the heating and ventilating fan, and is in a state where the circulation air path is formed. As a result, the air path switching plate 20 guides wind generated by operation of the motor 12 to flow through the heating device 154. After the wind is heated, it is blown into a room for achieving the effect of heating.

When a user uses the ventilation mode, as shown in FIG. 11B, firstly, the first switch 621 is brought into a closed state to complete the fan motor circuit 660, thereby energizing and operating the motor 12. Then, the second switch 622 is brought into an opened state. Since the coil 634 of the relay 630 is deenergized, the electromagnetic force does not exist. The normally opened terminal 633 is disconnected from the common terminal 631, and the common terminal 631 is restored to the state where it is connected to the normally closed terminal 632. Therefore, the timing motor 30 is energized and begins to operate.

When the timing motor 30 is in a deenergized state, the air path switching plate 20 is located in the position of the heating mode of the heating and ventilating fan, i.e., the air path switching plate 20 is in a state where it blocks the ventilation outlet of the frame of the heating and ventilating fan. As the timing motor 30 rotates, it generates power. Furthermore, since the air path switching plate 20 is connected to the timing motor 30 through the connection part, when the timing motor 30 rotates, the timing motor 30 drives the connection part to rotate downwards by a preset angle, the air path switching plate is rotated to the position of the ventilation mode while blocking the ventilation outlet of the frame of the heating and ventilating fan.

In this way, the interior air path is switched from the circulation air path (the air path in the heating mode) to the ventilation air path (the air path in the ventilation mode) to guide wind generated by operation of the motor 12 to be blown out of a room from the ventilation outlet for achieving the effect of ventilation.

With the above structure, the heating device drive circuit 650 and the air path switching plate drive circuit 640 are interlocked. In other words, when the heating and ventilating fan is in an operational state, the heating device 154 and the air path switching plate 20 cannot be started simultaneously. The air path switching plate 20 is in the deenergized state when the heating device 154 is started, while the heating device 154 is in the deenergized state when the air path switching plate 20 is started. Therefore, occurrence of a situation in which the heating device 154 and the air path switching plate 20 are started simultaneously can be avoided. When the heating and ventilating fan is in the ventilation mode, the heating device 154 will not be energized to be used.

With the above structure, a single-control switch with a low cost can be adopted for the control switch. Therefore, operation for wire connection is simplified while the cost is reduced.

In addition, as described above, in the above description, the terminal block 610 has a first terminal 611 connected to a neutral wire N as a pole of the power source, a second terminal 612 connected to a live wire L as the other pole of the power source, and a third terminal 613. However, even if the first terminal 611 is connected to the live wire L as a pole of the power source, and the second terminal 612 and the third terminal 613 are connected to the neutral wire N as the other pole of the power source, the effect of the present invention will not be changed.

The invention claimed is:

1. A heating and ventilating fan, comprising: a frame, a motor with fan blades, a casing, a heating device, and an air path switching plate disposed at an air outlet of the casing for switching outlets of the ventilating fan, characterized by further comprising:

a timing motor, wherein the timing motor and the air path switching plate are fixed on both sides of a frame wall, respectively, the air path switching plate is connected to a shaft of the timing motor through a connection part, and the timing motor controls the air path switching plate to rotate by a constant angle in a single direction; and a spring having a first end fixed to the frame wall, and a second end rotating synchronously with the air path switching plate, wherein the spring controls the air path switching plate to rotate in an opposite direction to the single direction, and when the timing motor is deenergized, the spring returns the air path switching plate to its rest position.

2. The heating and ventilating fan of claim 1, wherein the connection part has a rear end fixed to the shaft of the timing motor, and a front end fixed in a hollow shaft of the air path switching plate after passing through a connection hole formed in the frame wall, and the second end of the spring is fixed to the front end of the connection part.

3. The heating and ventilating fan of claim 2, wherein the front end of the connection part has a D-shaped cross section, a D-shaped hole is disposed in the hollow shaft of the air path switching plate, and the front end of the connection part is inserted and engaged in the D-shaped hole of the hollow shaft.

4. The heating and ventilating fan of claim 2, wherein the shaft of the timing motor is configured in a D-shape, and a D-shaped hole is disposed inside the rear end of the connection part, and is inserted the shaft of the timing motor.

5. The heating and ventilating fan of claim 2, wherein the first end of the spring is formed into a rear hook, the second end of the spring is formed into a front hook, and a spiral cylinder is formed between the front hook and the rear hook;

the front hook is shaped to cross the spiral cylinder diametrically, and inserted in a slit disposed in a center of the connection part to be fixed to the connection part; and the rear hook projects outwards from the spiral cylinder.

6. The heating and ventilating fan of claim 5, wherein a cylinder wall is disposed at the rear end of the connection part around the center to be spaced from the center, and the cylinder wall is provided with a notch larger than or equal to a range of an angle of rotation of the connection part.

7. The heating and ventilating fan of claim 6, wherein the rear hook of the spring projects outwards from the spiral cylinder beyond the notch of the cylinder wall and is formed in a Z shape, and a part of the rear hook of the spring can rotate in the notch.

8. The heating and ventilating fan of claim 5, wherein a positioning piece for fixing a position of the rear hook of the spring is formed on a side of the frame wall on which the timing motor is fixed, the positioning piece protrudes from an inside surface of the frame wall and a guide piece is disposed above the positioning piece to guide the rear hook of the spring to engage with the positioning piece, and an external side of the guide piece is shorter and an internal side of the guide piece adjoining the positioning piece is longer so that an inclined surface is formed to be inclined towards the positioning piece.

9. The heating and ventilating fan of claim 6, wherein an inner circular ring is formed at a periphery of the connection hole of the frame wall, and an outer circular ring surrounding the inner circular ring is also disposed at the periphery of the connection hole of the frame wall, and the cylinder wall of the connection part is mounted between the inner circular ring and the outer circular ring.

10. The heating and ventilating fan of claim 1, wherein whether the ventilating fan is in a heating mode or in a ventilation mode, the air path switching plate is located in a position in which it blocks a ventilation outlet when the ventilating fan is stopped.

11. The heating and ventilating fan of claim 1, further comprising: a relay for switching a heating device drive circuit for energizing the heating device or an air path switching plate drive circuit for energizing the air path switching plate, and when a coil of the relay is energized or deenergized, only one of the air path switching plate drive circuit and the heating device drive circuit is energized.

12. The heating and ventilating fan of claim 11, further comprising: a terminal block for receiving a power supplied from a power source, the terminal block has a first terminal connected to a pole of the power source, a second terminal connected to the other pole of the power source, and a third terminal, the relay has a common terminal, a normally closed terminal, and a normally opened terminal, the coil of the relay is connected between the first terminal and the second terminal of the terminal block, the common terminal is connected to the third terminal, the air path switching plate drive circuit is connected between the first terminal and the normally closed terminal, the heating device drive circuit is connected between the first terminal and the normally opened terminal, and a fan motor circuit for driving the motor with the fan blades is connected between the first terminal and the common terminal.

13. The heating and ventilating fan of claim 12, wherein a first switch and a second switch connected in series are disposed between the second terminal and the other pole of the power source, and the first switch is disposed between the third terminal and the other pole of the power source.

* * * * *